United States Patent [19]

Overfield

[11] 4,201,170

[45] May 6, 1980

[54] FUEL INJECTION PUMP WITH POSITIVE DISPLACEMENT DELIVERY VALVE HAVING TWO PORT AREAS OPENED ACCORDING TO FUEL FLOW RATE

[75] Inventor: Norbert W. Overfield, Bloomfield, Conn.

[73] Assignee: Stanadyne, Inc., Windsor, Conn.

[21] Appl. No.: 929,820

[22] Filed: Jul. 31, 1978

[51] Int. Cl.[2] ..... F02M 41/08; F04B 39/10

[52] U.S. Cl. ..... 123/139 BD; 123/139 AF; 417/456

[58] Field of Search ..... 123/139 R, 139 AF, 139 AA, 123/139 AK, 139 AT, 139 BD, 139 DP; 417/307, 456, 490, 499, 501, 569, 559, 462, 274, 301

[56] References Cited

U.S. PATENT DOCUMENTS

| | | | |
|---|---|---|---|
| 2,883,934 | 4/1959 | Roosa | 417/301 |
| 3,489,093 | 1/1970 | Thornber | 417/456 |
| 3,704,963 | 12/1972 | Baxter | 417/274 |
| 3,752,138 | 8/1973 | Gaines | 417/462 |
| 3,773,440 | 11/1973 | Tateishi | 417/490 |
| 3,861,833 | 1/1975 | Salzgeber et al. | 417/462 |
| 3,918,853 | 11/1975 | Drori | 123/139 BD |
| 4,074,668 | 2/1978 | Indra | 123/139 AF |

*Primary Examiner*—Charles J. Myhre
*Assistant Examiner*—P. S. Lall
*Attorney, Agent, or Firm*—Prutzman, Kalb, Chilton & Alix

[57] ABSTRACT

A diesel fuel injection system having a positive displacement fuel delivery valve with a valve piston with a conventional passage for delivering fuel to injection nozzles and a second more restricted passage at an intermediate axial position of the valve piston for delivering such fuel at lower pumping rates, such as during low speed engine cranking, so that the valve piston is displaced a lesser amount at lower pumping rates and thereby increase the downstream residual fuel pressure when the pumping rate is lower.

6 Claims, 8 Drawing Figures

10
11
12
14
16
18
20
22
24
28
30
31
32
34
36
38
40
42
46
48
50
51
52
53
54
55
56
58
62
64
66
68
70
72
74
75
76
78

18
53
106
166
162
124
156
108
104
46
102
160

FUEL INJECTION PUMP WITH POSITIVE DISPLACEMENT DELIVERY VALVE HAVING TWO PORT AREAS OPENED ACCORDING TO FUEL FLOW RATE

BRIEF SUMMARY OF THE INVENTION

The present invention relates to a fuel injection pump of the type used for sequentially delivering measured charges of fuel to the cylinders of an internal combustion engine. More particularly, the present invention relates to such a pump having an improved delivery valve for automatically increasing the residual pressure downstream of the delivery valve at lower pumping rates.

In the operation of internal combustion engines where fuel injection is employed, a metered charge of liquid fuel is delivered under high pressure to each engine cylinder in synchronism with the engine operating cycle. The size of the fuel charge is typically controlled during normal engine operation by an engine throttle with or without the aid of a governor which automatically varies the size of the fuel charge to maintain a throttle established speed either throughout the entire speed range of the engine or at just idle and maximum engine speeds. To facilitate starting the engine at low speed engine cranking, it is normally desirable to inject a fuel charge which is substantially larger than the fuel charge employed during normal engine operation. Increasing the residual pressure downstream of the delivery valve at low pumping rates will increase fuel charges under starting conditions as well as to compensate for delays in the timing of injection relative to the pumping event at low and moderate speeds and low loads.

Accordingly, it is a primary object of the present invention to provide a new and improved fuel injection control system for automatically increasing the residual pressure downstream of the delivery valve at lower pumping rates.

It is another object of the present invention to provide a new and improved fuel injection system delivery valve which provides a substantially larger available fuel injection charge at engine cranking speed.

It is another object of the present invention to provide a new and improved fuel injection pump for automatically preventing delays in the timing of injection at low and moderate pumping rates.

It is a further object of the present invention to provide a new and improved fuel delivery valve for rotary distributor type fuel injection pumps of conventional design which permits the pump to be readily adapted for each engine installation for delivering a pre-established relatively large fuel injection charge during engine cranking.

It is a further object of the present invention to provide a new and improved fuel injection pump positive displacement fuel delivery valve which maintains a higher positive downstream residual fuel pressure at low engine speed to increase the maximum available fuel charge for injection.

It is a still further object of the present invention to provide a new and improved fuel injection pump fuel delivery valve which may be employed with fuel delivery pumps having charge measure governing.

Other objects will be in part obvious and in part pointed out more in detail hereinafter.

A better understanding of the invention will be obtained from the following detailed description and the accompanying drawings of illustrative applications of the invention.

DESCRIPTION OF THE PREFERRED EMBODIMENTS

Figure 1:
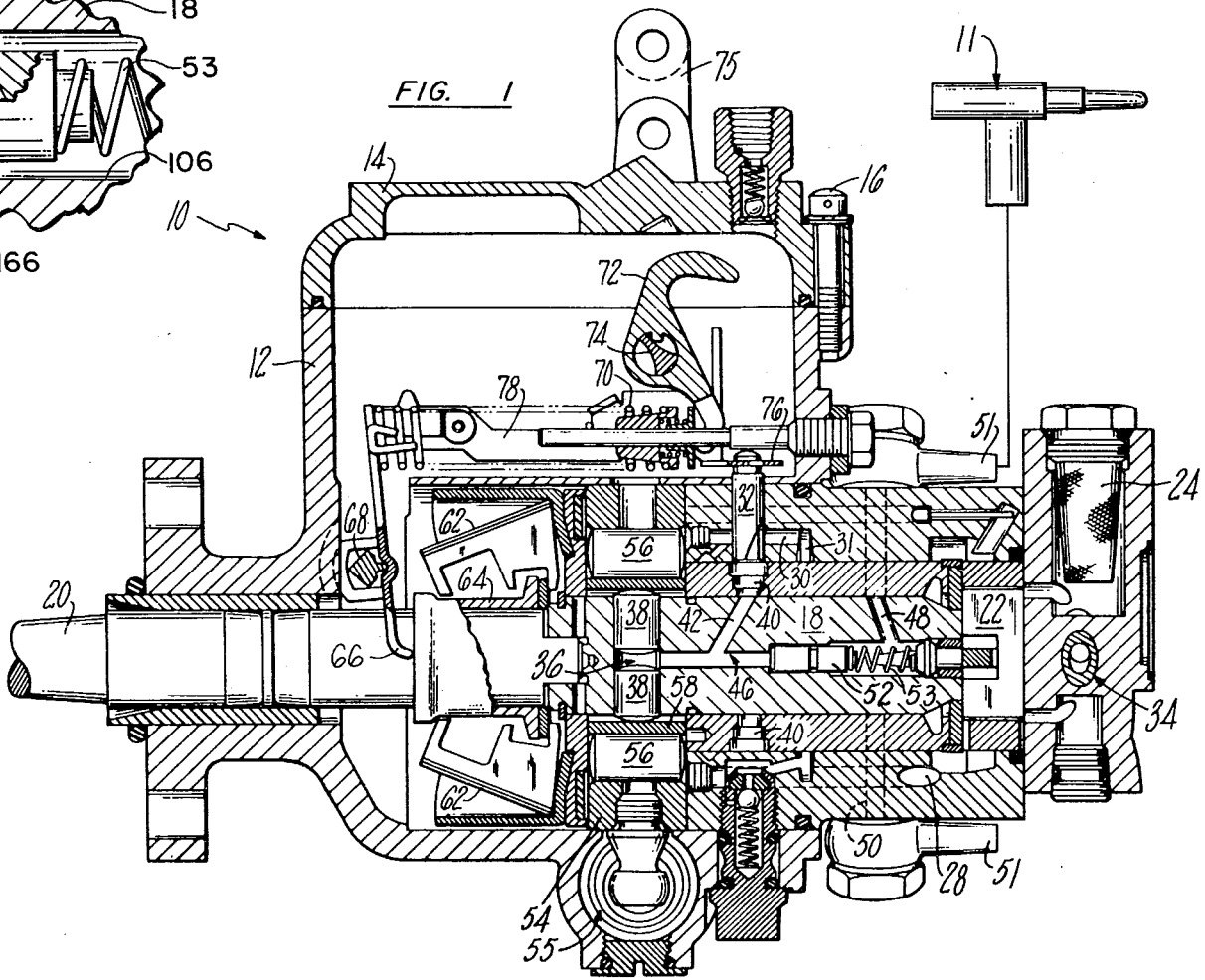
FIG. 1 includes a side elevation section view, partly broken away and partly in section, of a fuel pump incorporating a first embodiment of a fuel injection pump delivery valve of the present invention and a side view of a fuel injection nozzle connected to the fuel pump.

Referring now to the drawings in detail, a fuel pump 10 is shown in FIG. 1 of the type shown and described in U.S. Pat. No. 3,704,963 of Leonard N. Baxter, dated Dec. 5, 1972, and entitled "Fuel Pump." Briefly, the fuel pump 10 is adapted to supply measured pulses or charges of fuel to the several fuel injection nozzles 11 (only one of which is shown) of an internal combustion engine (not shown). A pump housing 12 having a cover 14 secured by fasteners 16 rotatably supports a pump rotor 18 having a drive shaft 20 with a tapered end for receiving a drive gear, not shown, to which the shaft 20 is keyed.

A vane-type transfer or low pressure supply pump 22 driven by the rotor 18 receives fuel from a reservoir, not shown, via a pump inlet 24 and delivers fuel under pressure via axial conduits 28, 30 and an annulus 31 to a metering valve 32. A transfer pump pressure regulating valve 34, which may be of the type disclosed and described in U.S. Pat. No. 2,883,934 of Vernon D. Roosa, dated Apr. 28, 1959, and entitled "Pressure Responsive Valve For Fuel Pumps," provides for regulating the output pressure of the transfer pump 22 and return excess fuel to the pump inlet 24. The regulator 34 is designed to provide a transfer pump output pressure which increases with engine speed in order to meet the increased fuel requirement of the engine at higher speeds and to provide a fuel pressure usable for operating auxiliary mechanisms of the fuel pump.

A high pressure charge pump 36 driven by the rotor 18 comprises a pair of opposed plungers 38 reciprocable in a diametral bore of the rotor. The charge pump 36 receives metered fuel from the metering valve 32 through a plurality of angularly spaced radial passages 40 adapted for sequential registration with a diagonal inlet passage 42 of the rotor as the rotor 18 is rotated. Fuel under high pressure is delivered by the charge pump 36 through an axial bore 46 in the rotor 18 to a radial distributor passage 48 adapted for sequential registration with a plurality of angularly spaced distributor outlet passages 50 which communicate with respective individual fuel injection nozzles 11 (only one of which is shown) of the engine through discharge fittings 51 spaced around the periphery of the housing 12. A delivery valve 52 hereinafter described in detail and incorporating the present invention is reciprocably mounted in the axial bore 46 and is axially biased to a closed position shown in FIG. 1 by a return compression spring 53. In addition to the functions provided by the present invention, the delivery valve provides in a conventional manner for achieving a sharp cut-off of fuel to the nozzles and thereby eliminate fuel dribble into the engine combustion chamber after fuel injection. The angularly spaced radial inlet passages 40 to the charge pump 36 and the angularly spaced outlet passages 50 of the rotary distributor are located to provide registration respectively with the diagonal pump inlet passage 42 during the intake stroke of the plungers 38 and with the outlet passage 48 during the compression stroke of the plungers 38.

An annular cam 54 having a plurality of pairs of diametrically opposed camming lobes is provided for actuating the charge pump plungers 38 inwardly together for periodically pressurizing the charge of fuel therein and for thereby periodically delivering pulses of pressurized fuel for injection of fuel charges into the engine cylinders. A pair of rollers 56 and roller shoes 58 are mounted in radial alignment with the plungers 38 by a rotor driven carrier, not shown, for camming the plungers inwardly. For timing the distribution of the pressurized fuel to the fuel nozzles in proper synchronism with the engine operation, the annular cam 54 is adapted to be angularly adjusted by a suitable timing mechanism 55.

A plurality of governor weights 62, angularly spaced about the pump shaft 20, provide a variable governing bias on a sleeve 64 which engages a governor plate 66 to urge it clockwise as viewed in FIG. 1 about a support pivot 68. The governor plate 66 is urged in the opposite pivotal direction by a compression spring 70 having a bias which is adjustable by a lever 72 operated by a throttle shaft 74 connected to a throttle arm 75. The governor plate 66 is connected for controlling the angular position of the metering valve 32 by a control arm 76 fixed to the metering valve and by a link 78 pivotally connected to the control arm 76 and normally biased by a tension spring, not shown, into engagement with the governor plate 66.

As is well known, the quantity or measure of the charge of fuel delivered by the charge pump 36 is readily controlled by varying the inlet fuel restriction with the metering valve 32. In the usual manner, the pump governor controls the angular position of the metering valve 32 to maintain the engine speed under varying engine load conditions at the speed established by the throttle shaft 74. Rotation of the metering valve 32 under the control of the pump governor varies the metering valve restriction between the passages 30 and 40 and thus varies the fuel delivered by the pump to maintain the associated engine at a speed determined by the setting of the governor.

In accordance with the present invention, the fuel pump delivery valve provides for automatically increasing the maximum available size of the measured charge of fuel at low engine/pump RPM and for thereby automatically increasing the size of the injected charge during low speed engine cranking when a larger charge is desired to facilitate combustion and engine starting.

Figure 2:
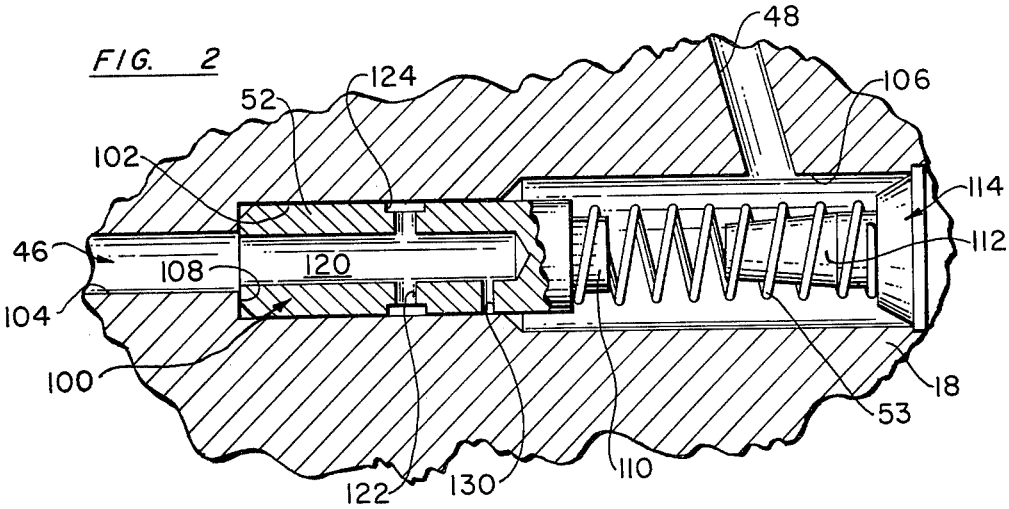
FIGS. 2, 3, and 4 are enlarged partial side elevation section views, partly broken away and partly in section, of the fuel pump showing the delivery valve in greater detail in closed, intermediate and fully open positions thereof respectively.
Figure 3:
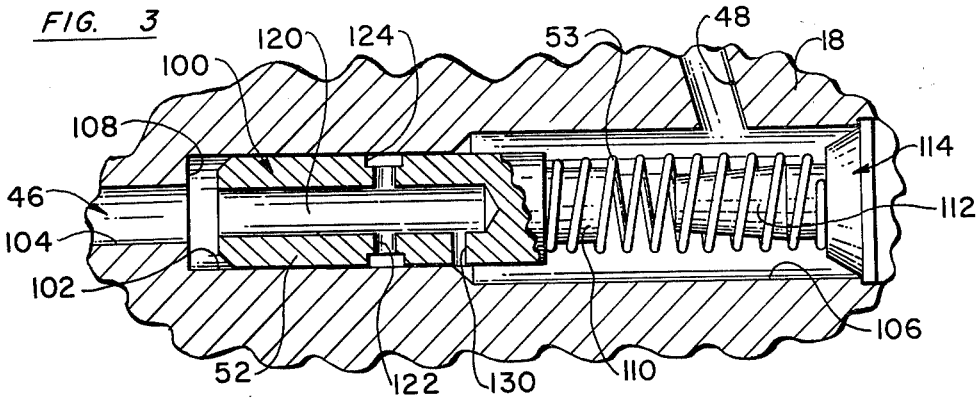
Figure 4:
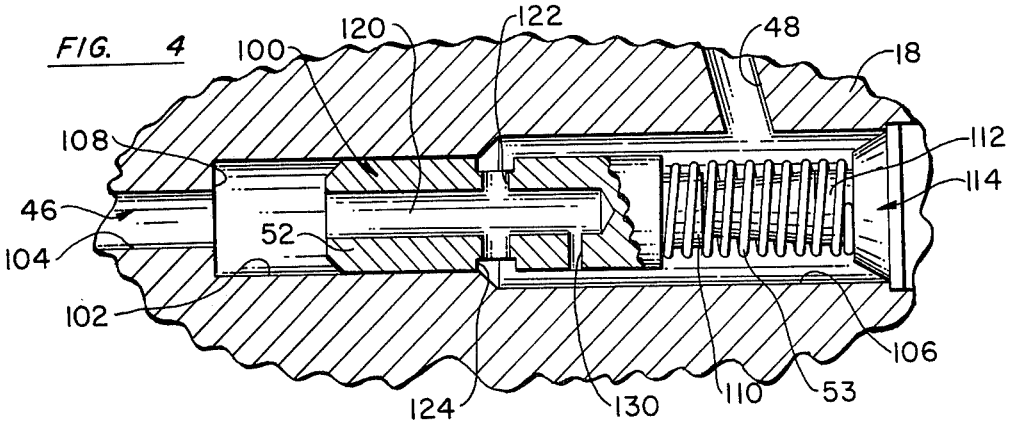

A first embodiment 100 of a delivery valve incorporating the present invention is shown in detail in FIGS. 2–4. The delivery valve 100 is a positive displacement or volume retraction type of delivery valve 52 and is mounted within an intermediate bore section 102 of the axial bore 46 of the rotor 18. The intermediate bore section 102 has a diameter intermediate that of a smaller upstream bore section 104 and a larger downstream bore section 106 forming a delivery chamber. The valve 52 has a closed axial position shown in FIG. 2 in engagement with a shoulder or stop 108 at the upstream end of the intermediate bore section 102 and against which it is biased by the delivery valve return spring 53. The return spring 53 is mounted on a reduced downstream end 110 of the valve 52 and an aligned projecting boss 112 of a conventional plug 114.

At high pumping rates which occur at high speed or load, the valve 52 is hydraulically actuated by each pulse of pressurized fuel from the charge pump 36 and is thereby adapted to be hydraulically actuated substantially to the fully open position shown in FIG. 4 where the valve 52 engages the boss 112. In that valve open position, fuel is free to flow unrestricted from the charge pump 36 to the distributor passage 48 via an axial inlet bore 120 and diametral bore 122 in the valve 52 and a peripheral valve annulus 124.

When the valve 52 is hydraulically actuated from its closed position shown in FIG. 2 to its open position shown in FIG. 4 by a pressurized pulse from the charge pump 36, the incipient axial motion or lift of the valve 52 pressurizes the downstream fuel to the active nozzle 11. When the valve 52 reaches its open position, pressurized fuel is delivered during the remainder of the charge pump pulse to increase the fuel pressure at the active nozzle to a predetermined level where fuel injection occurs. At the end of each charge pump pulse, the valve 52 is returned to its fully closed position shown in FIG. 2 by the return spring 53 and by the hydraulic force of the downstream pressurized fuel. As the valve 52 returns to its closed position, the volume of the downstream fuel passages is increased an amount depending on the retraction volume of the valve, say 40 $mm^3$, and the downstream fuel pressure is thereby reduced to a positive residual pressure level (e.g., of the order of 400 psi) which is substantially less than the predetermined pressure level (e.g., of the order of 2500 psi) required for hydraulically operating the fuel injection nozzle. Consequently, the possibility of an undesirable secondary fuel charge injection is avoided. However, the positive downstream residual fuel pressure is maintained at a suitable level between fuel injections to prevent downstream cavitation and to ensure substantially even fuel charge distribution to the engine cylinders.

In accordance with the present invention, an additional restricted passage or orifice 130 is provided in the valve 52 for connecting the charge pump 36 to the delivery chamber when the valve 52 reaches an axial position shown in FIG. 3 intermediate its open and closed positions. Opening motion of valve 52 will be limited to this amount when the flow rate is relatively lower, i.e., at low speed or low load since the area of orifice 130 can pass the entire flow in the time available. For example, the orifice 130 may have a 0.016 inch diameter and be effective to deliver fuel from the charge pump to the distributor after a nominal 5 $mm^3$ volumetric displacement of the valve 52 from its closed position.

Because the valve 52 is actuated only to its intermediate position during low speed engine cranking, the return displacement of the valve (e.g., 5 $mm^3$) during engine cranking is substantially less than the return displacement of the valve (e.g., 40 $mm^3$) from its open position. Accordingly, the residual pressure downstream of the valve 52 at the end of a charge pump pulse is substantially greater when the valve returns from its intermediate position than when it returns from its open position. Therefore, the positive residual fuel pressure at each fuel injection nozzle during engine cranking is higher and each charge pump pulse provides for injecting a substantially larger fuel charge. In other words, during low speed engine cranking, a smaller initial part of each charge pump pulse is required to raise the fuel pressure to the predetermined level where fuel injection occurs so that a larger remaining part of the charge pump pulse produces a corresponding larger fuel charge injection. Residual pressure downstream of valve 52 can be higher at low speed operation than at high speed operation without causing secondary injection since at low speed, the pumping rate is lower and pressure build-up during the pumping event does not cause the reflected pressure pulses to be high enough to reopen the injection nozzle.

During relatively high speed engine operation (e.g., above 500 RPM) when the charge pump pulse is of shorter duration and the valve 52 is hydraulically actuated to its open position shown in FIG. 4, a small percentage (which diminishes with increasing engine/charge pump speed) of the fuel delivered through the valve piston 52 to the distributor is delivered via the orifice 130 without, however, substantially affecting the size of the charge pulse or the charge timing. Also, upon return of the valve piston 52 from its open to its closed position shown in FIG. 2, a small amount of fuel (which decreases with increasing engine/charge pump speed) is returned to the upstream end of the valve via the orifice 130. The axial position of the primary diametral bore 122 is established to accommodate the return fuel flow via the orifice 130 to establish the desired downstream residual fuel pressure at relatively high speed engine operation. Also, the axial positions of the primary diametral bore 122 and the orifice 130 are preferably customized for each pump installation to maintain the desired positive residual fuel pressure at each injection nozzle between charge injections. For example, as previously indicated, the axial positions of the primary diametral bore 122 and orifice 130 are established to provide a return displacement of 5 $mm^3$ and 40 $mm^3$ respectively.

Figure 7:
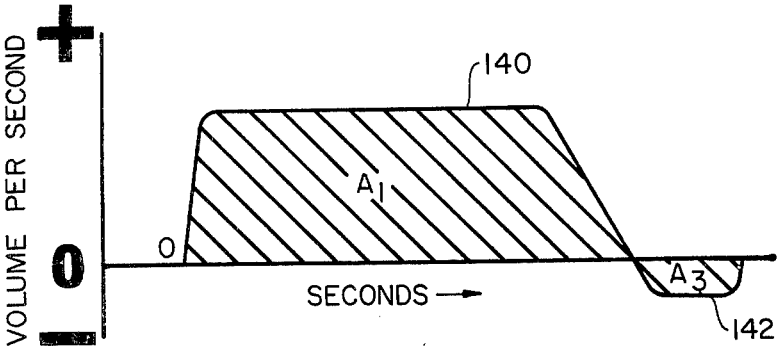
FIGS. 7 and 8 are representative graphs showing the relative fuel flow rates at the upstream end of the delivery valve of the present invention at relatively low engine speed and high engine speed respectively and at a constant charge pump displacement.
Figure 8:
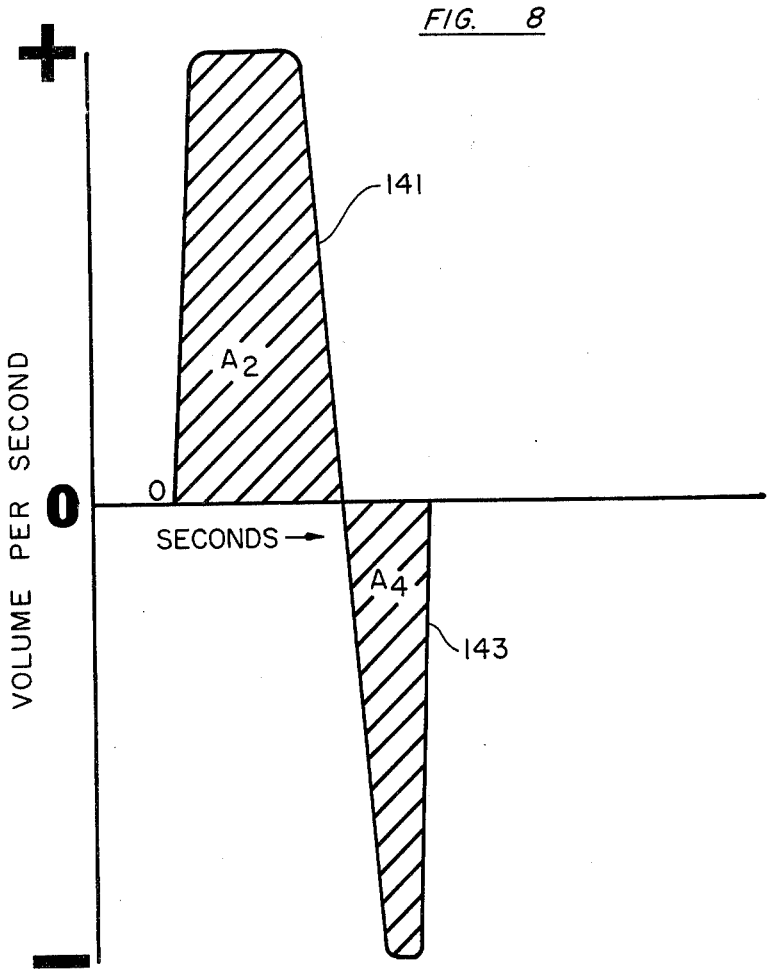

FIGS. 7 and 8 are representative graphs illustrating the direction and rate of fuel flow immediately upstream of the delivery valve 52 during a charge pump pulse at relatively low speed engine cranking (FIG. 7) and at relatively high speed engine operation (FIG. 8). In both graphs, the inlet metering valve 32 to the charge pump opened fully to deliver a maximum fuel pulse with the charge pump 36. Thus, in FIGS. 7 and 8, the volumes of the fuel pulses (represented by areas $A_1$ and $A_2$ of the positive flow rate curves 140, 141) is substantially the same. However, the volume of return fuel (represented by areas $A_3$ and $A_4$ of the negative flow return curves 142, 143) caused by the retraction or reseating of valve piston 52 is substantially less during low speed engine cranking (FIG. 7) than during relatively higher speed engine operation (FIG. 8). The difference between the areas $A_1$ and $A_3$ represents the volume of the injected fuel charge at low speed engine cranking and the difference between the areas $A_2$ and $A_4$ represents the volume of the injected fuel charge during relatively high speed engine operation. The graphs therefore illustrate that a substantially greater fuel charge is available at relatively low speed engine cranking than at relatively high speed engine operation. Of course, during engine operation the inlet metering valve 32 is automatically controlled to govern the engine speed and such that the maximum available fuel charge is injected only at substantial engine load.

Figure 5:
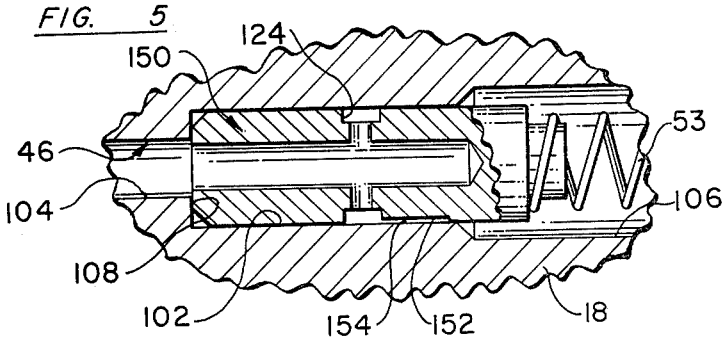

Referring to FIG. 5, a second embodiment of a fuel delivery valve 150 incorporating the present invention is shown having a peripheral flat 152 immediately downstream of the peripheral annulus 124 in lieu of the orifice 130 to provide a restricted passage or orifice 154 for delivering fuel at an intermediate position of the valve piston 150 (not shown). Thus, the orifice 154 functions to deliver fuel during low speed engine cranking in the manner of the orifice 130.

Figure 6:
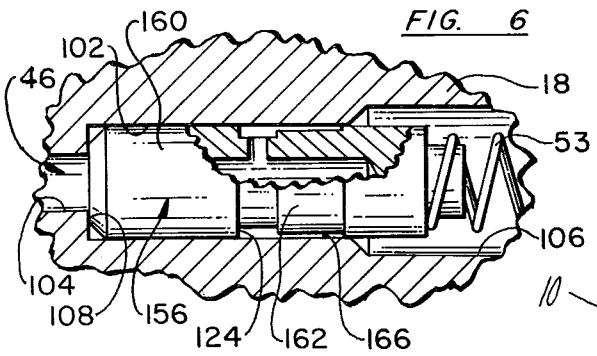
FIGS. 5 and 6 are enlarged partial side elevation section views, partly broken away and partly in section, showing second and third embodiments of a delivery valve of the present invention.

Another embodiment 156 of a fuel delivery valve incorporating the present invention is shown in FIG. 6. In that embodiment, the delivery valve 160 is formed with a reduced cylindrical section 162 immediately downstream of the peripheral annulus 124 to provide a restricted annulus or orifice 166 for delivering fuel at an intermediate position of the valve 156 during low speed engine cranking.

Also, the valve embodiments of FIGS. 5 and 6 are preferably custom designed for each fuel pump installation to provide the desired residual fuel pressure at the injection nozzles during relatively low speed engine cranking and relatively higher speed engine operation to provide for increasing the available fuel charge for low speed engine cranking.

The higher residual pressure at low speeds than at high speeds which results from the practice of this invention also improves the timing of injection.

In some fuel injection systems, the injection of fuel by the nozzle can be delayed with respect to the start of the pumping event at low to intermediate speeds and at low to moderate loads. If the residual pressure is too low under these conditions, the rate of pumping per unit time is low and this factor, coupled with other factors, such as the length of the fuel lines to the nozzles and the volume of fuel downstream of the delivery valve 52, can be sufficient to cause the nozzle not to open upon the arrival of the first pressure pulse resulting in delayed timing and erratic engine operation. The present invention causes residual pressure to be higher when pumping rate is low so that this undesirable delayed timing is avoided.

As will be apparent to persons skilled in the art, various modifications, adaptations and variations of the foregoing specific disclosure can be made without departing from the teachings of the present invention.

I claim:

1. A liquid fuel injection pump for a multicylinder internal combustion engine having a fuel injection nozzle for each cylinder for injecting a fuel charge into the cylinder when supplied with fuel under pressure above a predetermined level, a charge pump operable to generate periodic pulsed charges of pressurized fuel, a fuel distributor between the charge pump and the injection nozzles providing a delivery passage for sequentially delivering the pulsed charges of fuel to the several nozzles, a reciprocable delivery valve disposed in said delivery passage and providing a passageway for conducting fuel past the delivery valve, said delivery passage providing a stop for fixing the closed position of the delivery valve, and a spring biasing the delivery valve toward the stop against the pressure generated by the charge pump, characterized in that the delivery valve is a positive displacement delivery valve which closes said passage to prevent the flow of fuel in either direction when the delivery valve is engaged with the stop, said passageway having port means providing a restricted passage to accommodate only a low fuel flow rate when the delivery valve is displaced from the stop by a first distance, said port means providing a larger fuel flow area when the delivery valve is displaced from the stop its maximum distance to accommodate the unrestricted flow of fuel at high fuel flow rates whereby the delivery valve retracts after the delivery of each pulsed charge of fuel to a nozzle to reduce the residual pressure downstream of the delivery valve below the predetermined level at all fuel flow rates and to a lower level at high fuel flow rates than at low fuel flow rates.

2. The liquid fuel injection pump of claim 1 further characterized in that said port means comprises two axially spaced openings in the wall of said delivery valve one of which is opened when the delivery valve is displaced from the stop by said first distance and the other of which is opened only when the delivery valve is displaced from the stop by said maximum distance.

3. The liquid fuel injection pump of claim 1 further characterized in that said port means comprises an unrestricted opening in the wall of said delivery valve and a restricted passage extending downstream a limited distance therefrom, said restricted passage terminating short of the downstream end of said delivery valve.

4. The liquid fuel injection pump of claim 1 further characterized in that said delivery passage is a stepped passage and said port means is opened only when the delivery valve is displaced from the stop sufficiently for communication between said port means and the larger portion of said stepped passage.

5. The liquid fuel injection pump of claim 4 further characterized in that said port means comprises an opening in the wall of said delivery valve and a restricted passage extending downstream therefrom a limited distance, said restricted passage terminating short of the downstream end of said delivery valve and short of larger portion of said stepped passage when the delivery valve engages the stop.

6. The liquid fuel injection pump of claim 4 further characterized in that said port means comprises a pair of axially spaced openings in the wall of said delivery valve one of which is opened when the delivery valve is displaced from the stop by said first distance and the other of which is opened only when the delivery valve is displaced from the stop by said maximum distance.

* * * * *